US009393794B2

(12) United States Patent
Harada et al.

(10) Patent No.: US 9,393,794 B2
(45) Date of Patent: Jul. 19, 2016

(54) LIQUID EJECTING APPARATUS

(71) Applicant: SEIKO EPSON CORPORATION, Tokyo (JP)

(72) Inventors: Koji Harada, Shiojiri (JP); Koji Ito, Shiojiri (JP); Kazuyuki Fujioka, Matsumoto (JP); Hiroyuki Kawate, Hokuto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/954,137

(22) Filed: Nov. 30, 2015

(65) Prior Publication Data

US 2016/0159098 A1 Jun. 9, 2016

(30) Foreign Application Priority Data

Dec. 3, 2014 (JP) ..... 2014-244725

(51) Int. Cl.
*B41J 2/175* (2006.01)

(52) U.S. Cl.
CPC ..... *B41J 2/175* (2013.01)

(58) Field of Classification Search
CPC ..... B41J 2/17526; B41J 2/17509; B41J 2/17513; B41J 2/1752; B41J 2/1753; B41J 2/17533; B41J 2/17553
See application file for complete search history.

(56) References Cited

U.S. PATENT DOCUMENTS 5,444,472 A * 8/1995 Due ..... B41J 2/195 347/7

FOREIGN PATENT DOCUMENTS

| | | |
|---|---|---|
| EP | 1 083 054 | 3/2001 |
| JP | 2006-044153 | 2/2006 |
| JP | 2010-111092 | 5/2010 |
| JP | 2010 131757 | 6/2010 |
| JP | 2010-131757 | 6/2010 |
| JP | 2010131757 | * 6/2010 |
| JP | 2011-218714 | 11/2011 |
| JP | 2012-076243 | 4/2012 |
| JP | 2012-240270 | 12/2012 |
| WO | 02096654 | 12/2002 |

OTHER PUBLICATIONS

European Search Report for Application No. 15197149.6 dated Apr. 22, 2016.

* cited by examiner

*Primary Examiner* — Matthew Luu
(74) *Attorney, Agent, or Firm* — Workman Nydegger

(57) ABSTRACT

A liquid ejecting apparatus comprises: a liquid ejecting section that ejects liquid; a supply path through which the liquid is supplied from a liquid supply source to the liquid ejecting section; a movement mechanism that causes the liquid ejecting section to move; and a static mixer that is provided on the supply path and gives rise to a change in a flow of the liquid through the supply path; wherein the movement mechanism causes the liquid ejecting section to move before ejection of the liquid onto a medium by the liquid ejecting section, and the supply path located between the liquid ejecting section and the static mixer moves due to the movement.

9 Claims, 8 Drawing Sheets

LIQUID EJECTING APPARATUS

BACKGROUND

1. Technical Field

The present invention relates to a liquid ejecting apparatus, for example, an ink-jet printer.

2. Related Art

An ink-jet printer is known as an example of a liquid ejecting apparatus. An ink-jet printer performs printing by ejecting ink (liquid) that contains precipitating ingredients such as pigment from a head onto paper (medium). In such a printer, if a stationary state of ink without flow continues for a long time, the quality of printing performed after this state is poor in some cases because a difference in ink density arises due to the precipitation of pigment contained in the ink.

In order to avoid this problem, the following technique has been proposed in related art (for example, refer to JP-A-2010-131757). An ink cartridge, which contains ink, is in communication with an ink tank through communication passages formed therebetween. A static mixer is provided inside the communication passage. Ink is caused to flow through the communication passages. Since the ink flows through the static mixer during the process of going and coming back through the communication passages between the ink cartridge and the ink tank, precipitation is reduced as if the ink were actually stirred.

The size of the printer described above is large because a mechanism for causing ink to go and come back is required. That is, in the printer disclosed in JP-A-2010-131757, it is necessary to provide the ink cartridge and the ink tank as the source and destination of ink flow.

The problem described above is not limited to a printer that ejects ink that contains pigment. The same problem arises in a liquid ejecting apparatus that ejects liquid that contains precipitating ingredients.

SUMMARY

An advantage of some aspects of the invention is to provide a liquid ejecting apparatus that makes it possible, with a simple structure, to reduce the precipitation of precipitating ingredients contained in liquid when performing liquid ejection.

Solving means according to some aspects, and operational effects thereof, are described below.

A liquid ejecting apparatus according to one aspect comprises: a liquid ejecting section that ejects liquid; a supply path through which the liquid is supplied from a liquid supply source to the liquid ejecting section; a movement mechanism that causes the liquid ejecting section to move; and a static mixer that is provided on the supply path and gives rise to a change in a flow of the liquid through the supply path; wherein the movement mechanism causes the liquid ejecting section to move before ejection of the liquid onto a medium by the liquid ejecting section, and the supply path located between the liquid ejecting section and the static mixer moves due to the movement.

In this structure, the liquid in the portion of the supply path located between the liquid ejecting section and the static mixer moves due to the movement of the liquid ejecting section. Therefore, the liquid is stirred. On the other hand, the liquid located closer to the liquid supply source as compared with the static mixer flows through the static mixer when flowing toward the liquid ejecting section upon liquid ejection by the liquid ejecting section. Because of changes in the flow of the liquid, precipitation is reduced as if the liquid were actually stirred. Therefore, when liquid that contains precipitating ingredients is ejected, it is possible to reduce the precipitation of the ingredients with a simple structure.

In the liquid ejecting apparatus described above, preferably, the supply path should include a path area that has a level difference; and, on the supply path, the static mixer should be provided at a position closer to the liquid ejecting section than the path area having the level difference is.

In liquid that contains precipitating ingredients, the ingredients tend to gather at a relative low position. For this reason, at the path area having the level difference, there is a tendency that the density of the ingredients is high at a low position and is low at a high position. In this respect, in this structure, on the supply path, the static mixer is provided at a position closer to the liquid ejecting section than the path area having the level difference is. Therefore, it is possible to supply, to the liquid ejecting section, liquid located at the path area having the level difference, at which the density difference of precipitating ingredients contained in the liquid is more likely to occur due to precipitation, after reducing the precipitation by causing the liquid to flow through the static mixer.

Preferably, the liquid ejecting apparatus described above should further comprise: a liquid reservoir that retains the liquid and is provided on the supply path at a position closer to the liquid ejecting section than the static mixer is, wherein at least a part of the liquid reservoir should be made of a flexible member.

Since the static mixer gives rise to a change in the flow of liquid through the supply path, the pressure of the liquid supplied to the liquid ejecting section through the supply path also fluctuates. In this respect, in this structure, the liquid reservoir, at least a part of which is made of the flexible member, is provided on the supply path at a position closer to the liquid ejecting section than the static mixer. Therefore, it is possible to mitigate pressure fluctuations caused due to the flow of liquid through the static mixer by means of the liquid reservoir provided therebetween.

In the liquid ejecting apparatus described above, preferably, a swing member configured to be able to swing due to the movement of the liquid ejecting section by the movement mechanism should be provided inside the liquid reservoir. Since the swing member is provided inside the liquid reservoir, the swing member swings inside the liquid reservoir when the movement mechanism causes the liquid ejecting section to move. Therefore, it is possible to stir the liquid inside the liquid reservoir efficiently.

Preferably, the liquid ejecting apparatus described above should further comprise: an ejecting-section-side filter that is provided on the supply path at a position closer to the liquid ejecting section than the liquid reservoir is. When liquid flows through the static mixer, a foreign object contained in the liquid is also stirred. The stirring makes it easier for the foreign object to flow as the liquid flows, and makes it easier for the foreign object to be supplied toward the liquid ejecting section. When air bubbles pass through the static mixer, they become smaller due to division, and the buoyant force of them becomes smaller than that before size reduction. The reduction in the buoyant force makes the stay inside the supply passage less likely to occur and makes it easier for them to be supplied toward the liquid ejecting section. In this respect, in this structure, liquid that has flowed through the static mixer flows through the ejecting-unit-side filter before being supplied to the liquid ejecting section. Therefore, even though flowing through the static mixer makes it easier for a foreign object and air bubbles to be supplied toward the liquid ejecting section, it is possible to trap the foreign object and the air bubbles by means of the ejecting-unit-side filter.

In the liquid ejecting apparatus described above, preferably, the liquid ejecting section should perform maintenance operation of discharging the liquid from a nozzle before the ejection of the liquid onto the medium. A reduction in precipitation that is achieved by causing liquid to flow through the static mixer is greater than a reduction in precipitation that is achieved by moving the liquid ejecting section. When liquid is discharged from the nozzles during maintenance operation, replenishing liquid whose amount corresponds to the amount of the liquid discharged is supplied from the liquid supply source to the liquid ejecting section through the static mixer. Therefore, with this structure, as compared with a case where liquid is stirred by moving the liquid ejecting section, it is possible to eject liquid with a greater reduction in precipitation onto the medium.

Preferably, the liquid ejecting apparatus described above should further comprise: a branch path, one end of which is connected on the supply path to a position closer to the liquid supply source than the static mixer is, the other end of which is connected on the supply path to a position closer to the liquid ejecting section than the static mixer is, the branch path and the supply path working together so as to constitute a circulation path for circulation of the liquid; and a flow mechanism that causes the liquid inside the circulation path to flow.

In this structure, liquid caused to flow by the flow mechanism circulates along the circulation path. Since the liquid flows through the static mixer in this process, it is possible to further reduce precipitation.

In the liquid ejecting apparatus described above, preferably, the flow mechanism should perform circulating operation of causing the liquid to circulate along the circulation path; after the circulating operation, the liquid ejecting section should perform maintenance operation of discharging the liquid from a nozzle; and after the maintenance operation, the liquid ejecting section should eject the liquid onto the medium.

With this structure, when the circulating operation is performed by the flow mechanism, the precipitation of liquid inside the circulation path is reduced. Since maintenance operation is performed after the circulating operation, liquid with a reduction in precipitation by circulation along the circulation path is supplied to the liquid ejecting section. Therefore, by ejecting liquid onto the medium after the maintenance operation, it is possible to eject the precipitation-reduced liquid onto the medium.

Preferably, the liquid ejecting apparatus described above should further comprise: a supply-source-side filter that is provided, in the circulation path, either on the supply path at a position closer to the liquid supply source than the static mixer is or on the branch path, or on both, wherein the flow mechanism should cause the liquid to flow through the supply path from the liquid supply source toward the liquid ejecting section.

In this structure, the flow mechanism causes liquid to flow in such a way that the direction of liquid circulation along the circulation path is the same as the supply direction from the liquid supply source to the liquid ejecting section through the supply path, and causes the liquid to flow through the supply-source-side filter. Therefore, it is possible to prevent a foreign object or air bubbles trapped by the supply-source-side filter in the course of circulation of liquid by the flow mechanism from coming off from the supply-source-side filter and flowing together with the liquid when the liquid is supplied from the liquid supply source to the liquid ejecting section.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

With reference to the accompanying drawings, as an example of a liquid ejecting apparatus, an ink-jet printer according to a first embodiment of the invention that prints an image including characters, graphics objects, etc. by ejecting ink as an example of liquid will now be explained.

Figure 1:
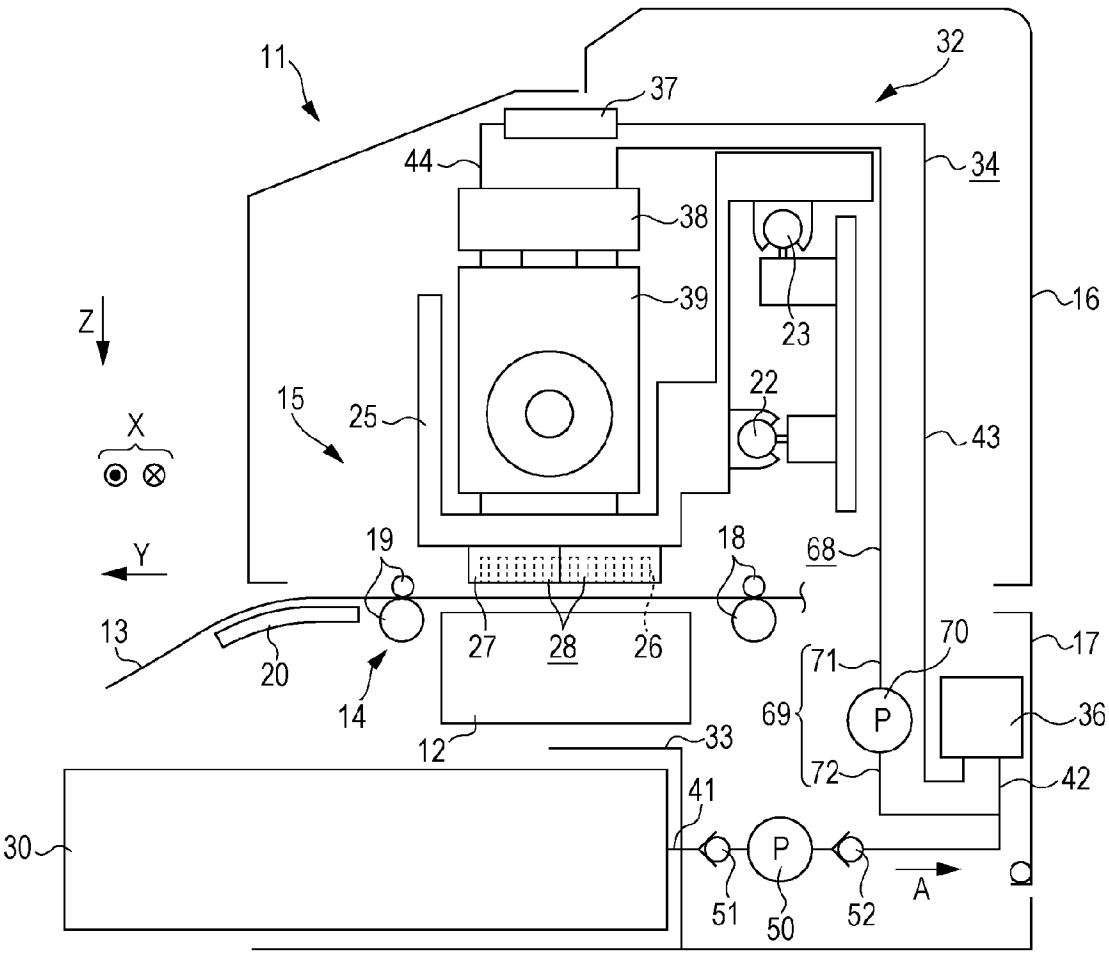
FIG. 1 is a schematic diagram of a printer according to a first embodiment.

As illustrated in FIG. 1, a printer 11 includes a transportation unit 14, which transports a sheet 13 in a transportation direction Y along the surface of a supporting table 12, and a printing unit 15, which performs printing by ejecting ink onto the transported sheet 13. The sheet 13 is supported as an example of a medium on the supporting table 12.

The supporting table 12, the transportation unit 14, and the printing unit 15 are fixed to a printer body 16 such as a housing, a frame, or the like. The supporting table 12 extends inside the printer 11 in the width direction of the sheet 13 (in a direction orthogonal to the drawing sheet face of FIG. 1). A cover 17, which can be opened and closed, is provided as a portion of the printer body 16.

The transportation unit 14 includes pairs of transportation rollers 18 and 19 provided respectively upstream and downstream of the supporting table 12 in the transportation direction Y. In addition, the transportation unit 14 includes a guide plate 20, which is provided downstream of the pair of transportation rollers 19 in the transportation direction Y and guides the sheet 13 while supporting the sheet 13. Driven by a transportation motor (not illustrated), the pairs of transportation rollers 18 and 19 rotate while pinching the sheet 13. By this means, the transportation unit 14 transports the sheet 13 along the surface of the supporting table 12 and the surface of the guide plate 20.

The printing unit 15 includes guide shafts 22 and 23, which extend in a scan direction X, and a carriage 25, which can reciprocate in the scan direction X while being guided by and along the guide shafts 22 and 23. The scan direction X is the width direction of the sheet 13 and is orthogonal to (intersects with) the transportation direction Y of the sheet 13. Driven by a carriage motor 24 (refer to FIG. 2), the carriage 25 moves in the scan direction X.

At least one liquid ejecting unit 28 (two units in the present embodiment), which has a nozzle surface 27, is mounted on the bottom of the carriage 25. Nozzles 26, from which ink is ejected, are formed in the nozzle surface 27. The nozzle surface 27 of the liquid ejecting unit 28 on the carriage 25 faces the supporting table 12 at a predetermined distance therefrom in a vertical direction Z. The liquid ejecting unit 28 moves in the scan direction X together with the carriage 25 driven by the carriage motor 24. In this respect, the carriage 25 functions as an example of a movement mechanism that causes the liquid ejecting unit 28 to move. The two liquid ejecting units 28 of the present embodiment are arranged with a predetermined clearance therebetween in the scan direction X and at a predetermined distance from each other in the transportation direction Y.

Figure 2:
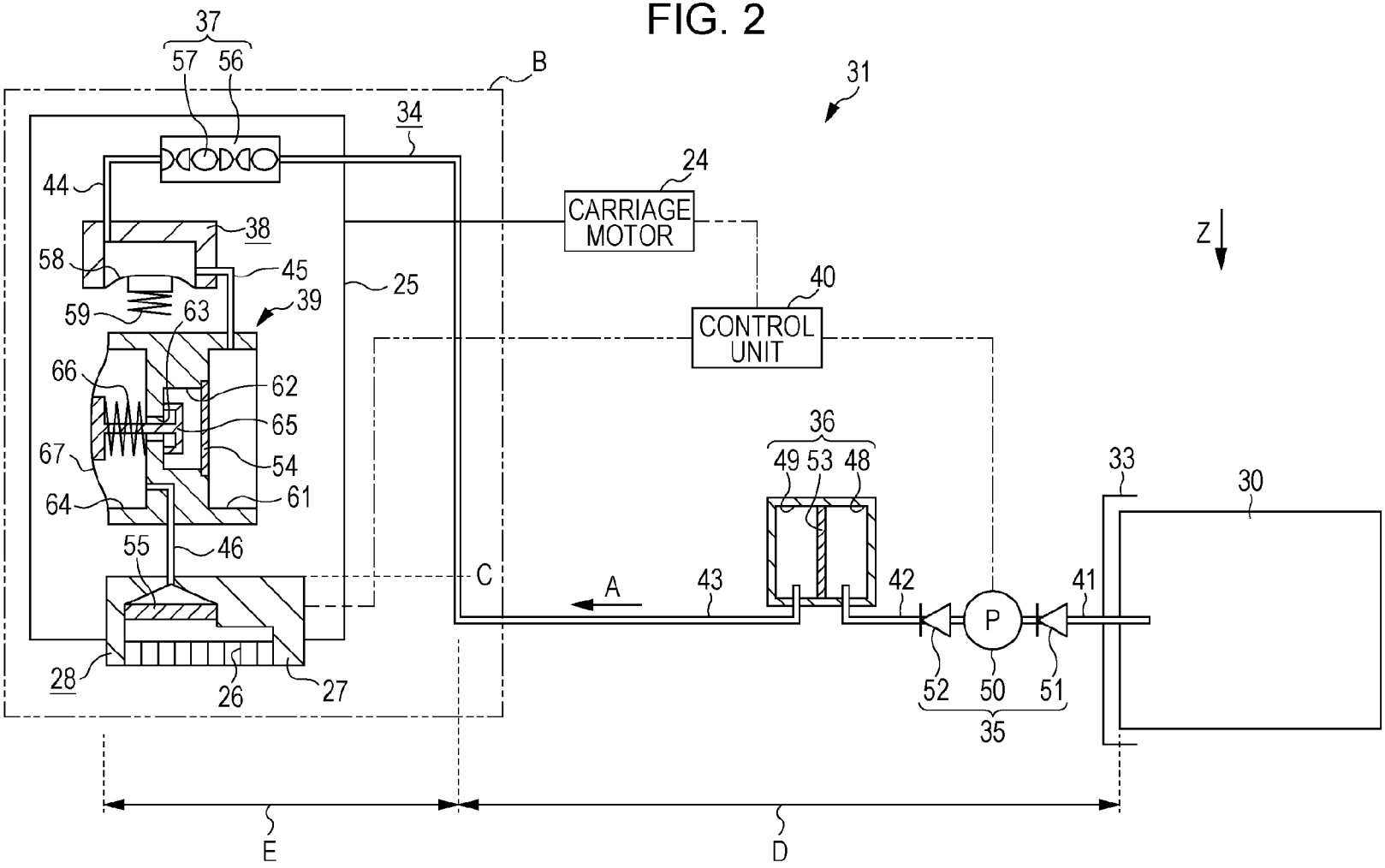
FIG. 2 is a schematic diagram of a first supply mechanism.
Figure 3:
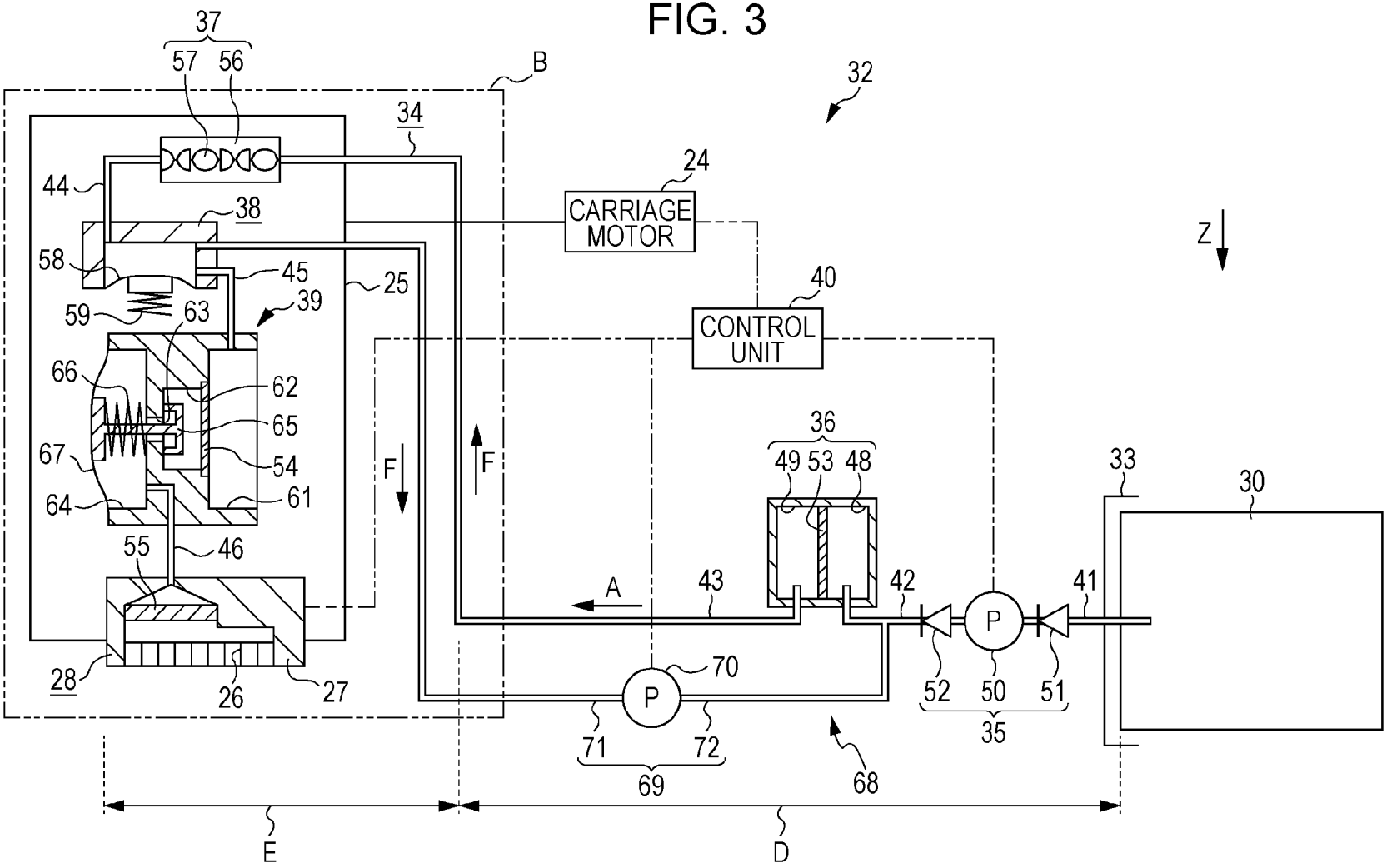
FIG. 3 is a schematic diagram of a second supply mechanism.

As illustrated in FIGS. 1, 2, and 3, a part of supply mechanisms 31 and 32 for supplying ink from a liquid supply source 30 to the liquid ejecting unit 28 is mounted on the carriage 25. The supply mechanism 31, 32 causes ink to flow in a supply direction A from the liquid supply source 30, which is the upstream side, to the liquid ejecting unit 28, which is the downstream side. At least one set (four sets in the present embodiment) of the liquid supply source 30 and the supply mechanism 31, 32 is provided, wherein the set is provided for each type of ink.

The liquid supply source 30 is an ink container. For example, it may be a replaceable ink cartridge for replenishment. Alternatively, it may be a tank fixed to an attachment portion 33. If the liquid supply source 30 is a cartridge, the attachment portion 33 holds the liquid supply source 30 detachably. The attachment portion 33 of the present embodiment is capable of holding plural liquid supply sources 30 containing different types or colors of ink.

Color printing or black-and-white printing can be performed by supplying color ink or functional liquid contained in the liquid supply sources 30 to the liquid ejecting units 28. Some examples of the colors of ink are: cyan, magenta, yellow, black, white, silver, light cyan, light magenta, light yellow, orange, green, and gray. Selection among them can be made arbitrarily. An example of the functional liquid is pretreatment or post-treatment liquid ejected onto the sheet 13 before or after the ejection of ink onto the sheet 13 for the purpose of improving the gloss or fixation property of the ink on the sheet 13.

White ink is used for, for example, undercoat printing (solid printing (paint-over-in-white)) before color printing in a case where the sheet 13 is a transparent or semitransparent film or where the sheet 13 is a dark-colored medium. The printer 11 of the present embodiment uses four colors, specifically, cyan, magenta, yellow, and white.

In a kind of ink that contains precipitating ingredients, for example, pigment ink, which contains pigment particles, there is a possibility of the precipitation of the ingredients in its solvent over time. The proneness of pigment ink to precipitation differs depending on the types (e.g., colors) of ink. Among pigment ink of cyan, magenta, yellow, and white, white ink is the most prone to precipitation.

Therefore, the printer 11 of the present embodiment is provided with three first supply mechanisms 31 (refer to FIG. 2), which supply cyan ink, magenta ink, and yellow ink to the liquid ejecting unit 28 respectively, and one second supply mechanism 32 (refer to FIGS. 1 and 3), which supplies white ink to the liquid ejecting unit 28. Since the structure of the plural first supply mechanisms 31 is identical, an explanation of one first supply mechanism 31 only is given below.

As illustrated in FIG. 2, the first supply mechanism 31 includes a supply path 34 through which ink is supplied from the liquid supply source 30 to the liquid ejecting unit 28. A supply pump 35, which causes ink to flow in the supply direction A, is provided on the supply path 34. A filter unit 36 is provided detachably on the supply path 34. The supply path 34 has a movable range portion B, which moves due to the movement of the carriage 25. In the range B, a static mixer 37, which gives rise to changes in the flow of ink through the supply path 34 (for example, changes in the direction of the flow and the divisions of the flow), a liquid reservoir 38, which retains the ink, and a pressure regulation valve 39, which regulates the pressure of the ink, are provided. The printer 11 includes a control unit 40, which controls the driving of the carriage motor 24, the driving of the supply pump 35, and the ejection of ink from the liquid ejecting unit 28.

The supply path 34 is made up of plural supply passages 41 to 46. Specifically, a first supply passage 41 connects the liquid supply source 30 to the supply pump 35. A second supply passage 42 connects the supply pump 35 to an upstream compartment 48 of the filter unit 36. A third supply passage 43 connects a downstream compartment 49 of the filter unit 36 to the upstream end of the static mixer 37. A fourth supply passage 44 connects the downstream end of the static mixer 37 to the liquid reservoir 38. A fifth supply passage 45 connects the liquid reservoir 38 to the pressure regulation valve 39. A sixth supply passage 46 connects the pressure regulation valve 39 to the liquid ejecting unit 28.

The supply pump 35 includes a diaphragm pump 50, the chamber capacity of which is variable, an inlet value 51, which is provided upstream of the diaphragm pump 50, and an outlet value 52, which is provided downstream of the diaphragm pump 50. The inlet valve 51 and an outlet valve 52 behave as a one-way valve that allows ink to flow in the supply direction A from the liquid supply source 30 toward the liquid ejecting unit 28 and prevents the backflow of the ink from the liquid ejecting unit 28 toward the liquid supply source 30. Therefore, the supply pump 35 takes in liquid from the liquid supply source 30 through the inlet value 51 when the capacity of the pump chamber of the diaphragm pump 50 increases, and presses out the liquid toward the liquid ejecting unit 28 through the outlet value 52 when the capacity of the pump chamber of the diaphragm pump 50 decreases.

The filter unit 36 is provided on the supply path 34 at a position closer to the liquid supply source 30 than the static mixer 37 is, and, in addition, is detachable from the second supply passage 42 and the third supply passage 43. In addition, the filter unit 36 is provided at a position corresponding to the cover 17 of the printer body 16 so as to be replaceable by opening the cover 17.

The filter unit 36 is provided with a supply-source-side filter 53, which is a partition filter between the upstream compartment 48 and the downstream compartment 49. The pressure regulation valve 39 is provided with an ejecting-unit-side filter 54, which is provided at a position closer to the liquid ejecting unit 28 than the liquid reservoir 38 is. An inside-ejecting-unit filter 55 is provided inside the liquid ejecting unit 28, to which the downstream end of the supply path 34 is connected. These filters trap air bubbles and a foreign object contained in ink.

The static mixer 37 is provided in a tilted state in such a manner that the upstream end, which is connected to the third supply passage 43, is located above the downstream end, which is connected to the fourth supply passage 44. The static mixer 37 includes a cylindrical housing 56 and plural split plates 57. The split plates 57 are provided inside the cylindrical housing 56 as a string of elements in the axial direction of the cylindrical housing 56. The string of the split plates 57 has an alternate reverse twisted structure. When liquid flows through each of the split plates 57, new rotational twist and flow division are applied to the liquid. By this means, the static mixer 37 mixes the liquid uniformly. The split plate 57 has a shape of a substantially rectangular plate material twisted by 180°. Each two adjacent split plates 57 are fixed with an angular shift of 90° from each other. Even when the static mixer 37 receives inflow pressure due to the entering of ink through one end of the cylindrical housing 56 in the axial direction, the split plates 57 are stationary, and the ink flows through channels formed by the split plates 57. As long as the split plates 57 are fixed to be stationary on the supply path 34, it is not necessary that the static mixer 37 should be provided with the cylindrical housing 56. That is, the split plates 57 that function as a bare static mixer 37 may be provided directly on the supply path 34.

Ink having flowed into the cylindrical housing 56 of the static mixer 37 undergoes flow changes including the reversing of the direction of the flow by the split plates 57 and the dividing of the flow by the split plates 57 and thereafter flows out of the cylindrical housing 56. In other words, the flow of the ink changes during the process of flowing through the static mixer 37. As a result, precipitation is reduced as if the ink were actually stirred. In the description below, the flowing of ink through the static mixer 37 is referred to as the "stirring" of the ink by the static mixer 37.

The liquid reservoir 38, which retains ink flowing in through the supply path 34, is provided on the supply path 34 at a position closer to the liquid ejecting unit 28 than the static mixer 37 is. A part of the liquid reservoir 38 is made of a flexible member 58. The flexible member 58 can be formed by, for example, forming an opening through a part of the wall surface of the liquid reservoir 38 and by fusion-bonding a deformable film in such a way as to close the opening. The flexible member 58 is urged by a spring 59 in a direction of decreasing the capacity of the liquid reservoir 38. The urging force applied indirectly by the spring 59 to ink, with the flexible member 58 sandwiched therebetween, is configured to be less than the force of pressing the ink by the supply pump 35. The downstream end of the fourth supply passage 44 is connected to the liquid reservoir 38 at a position above, in the vertical direction Z, a position where the upstream end of the fifth supply passage 45 is connected to the liquid reservoir 38.

The pressure regulation valve 39 includes a filter compartment 61 and a supply compartment 62. These two compartments are partitioned from each other by the ejecting-unit-side filter 54. In addition, the pressure regulation valve 39 includes a pressure compartment 64, which is in communication with the supply compartment 62 through a communication hole 63, a valve element 65, which is provided between the pressure compartment 64 and the supply compartment 62, and an urging member 66, which urges the valve element 65 in a valve-closing direction. The valve element 65 is inserted through the communication hole 63. The communication hole 63 is closed by the valve element 65 urged by the urging member 66.

A part of the wall surface of the pressure compartment 64 is made of a diaphragm 67, which is deformable in the urging direction of the urging member 66. The outer surface of the diaphragm 67 (the left side in FIG. 2) receives atmospheric pressure. The inner surface of the diaphragm 67 (the right side in FIG. 2) receives the pressure of ink retained inside the pressure compartment 64. Therefore, the diaphragm 67 deforms in accordance with the pressure difference between the internal pressure of the pressure compartment 64 and the external pressure applied to the outer surface.

The supply compartment 62 is kept in a pressurized state by pressurized ink supplied from the liquid supply source 30. When the pressure difference between the internal pressure of the pressure compartment 64 and the external pressure applied to the outer surface becomes less than a predetermined pressure value, a change into a state of communication between the pressure compartment 64 and the supply compartment 62 from a non-communication state, in which the communication between the pressure compartment 64 and the supply compartment 62 is stopped by the valve element 65 urged by the urging member 66, occurs. When the pressure difference between the internal pressure of the pressure compartment 64 and the external pressure applied to the outer surface reaches the predetermined pressure value, the valve element 65 stops the communication between the pressure compartment 64 and the supply compartment 62. In this way, in order to regulate the internal pressure of the liquid ejecting unit 28, which is the back pressure of the nozzles 26, the pressure regulation valve 39 regulates the pressure of ink supplied to the liquid ejecting unit 28 through the supply path 34.

The fifth supply passage 45 is connected to a top position of the filter compartment 61 in the vertical direction Z. Therefore, air bubbles trapped by the ejecting-unit-side filter 54 move into the liquid reservoir 38 through the fifth supply passage 45.

The third supply passage 43 for connection between the filter unit 36, which is attached to the printer body 16, and the static mixer 37, which is mounted on the carriage 25, is made of a flexible tube. Therefore, when the carriage 25 moves, in the supply path 34, a part of the third supply passage 43 also moves together with the fourth, fifth, and sixth supply passages 44, 45, and 46, which are provided at respective positions closer to the liquid ejecting unit 28 than the third supply passage 43 is.

The upstream end of the third supply passage 43 at the filter unit 36 is provided below the downstream end of the third supply passage 43 at the static mixer 37 in the vertical direction Z. A part of the upstream-side portion of the third supply passage 43, in addition to the first supply passage 41 and the second supply passage 42, is located below a connection position C where the sixth supply passage 46 is connected to the liquid ejecting unit 28 in the vertical direction Z. Therefore, the supply path 34 has, as its portion, a low area D, which is below the connection position C where the sixth supply passage 46 is connected to the liquid ejecting unit 28 in the vertical direction Z. The static mixer 37 is provided on the supply path 34 above the connection position C in the vertical direction Z at a high area E, which is closer in the flow to the liquid ejecting unit 28 than the low area D is. In other words, the supply path 34 includes a path area that has a level difference in the vertical direction Z for connection between the low area D and the high area E, and, on the supply path 34, the static mixer 37 is provided above the liquid ejecting unit 28 in the vertical direction Z at a position closer to the liquid ejecting unit 28 than the path area having the level difference is.

As illustrated in FIGS. 1 and 3, the structure of the second supply mechanism 32 is substantially the same as the structure of the first supply mechanism 31 except that a branch path is provided additionally. Therefore, the same reference numerals are assigned to the same components, and an explanation of them is not given here.

The second supply mechanism 32 includes a branch path 69. The branch path 69 and the supply path 34 work together so as to constitute a circulation path 68, which is a route for circulation of ink. One end of the branch path 69 is connected on the supply path 34 to a position closer to the liquid supply source 30 than the static mixer 37 is. The other end of the branch path 69 is connected on the supply path 34 to a position closer to the liquid ejecting unit 28 than the static mixer 37 is. A flow mechanism 70, which causes the ink inside the circulation path 68 to flow, is provided on the branch path 69.

Specifically, the branch path 69 is made up of a first branch passage 71, which connects the liquid reservoir 38 to the flow mechanism 70, and a second branch passage 72, which connects the flow mechanism 70 to the second supply passage 42. That is, the circulation path 68 is made up of the second supply passage 42, the third supply passage 43, the fourth supply passage 44, the first branch passage 71, and the second branch passage 72. The filter unit 36, the static mixer 37, the liquid reservoir 38, and the flow mechanism 70 are provided on the circulation path 68. The first branch passage 71 is made of a flexible tube similar to that of the third supply passage 43. When the carriage 25 moves, a part of this tube also moves.

The flow mechanism 70 is, for example, a gear pump or a diaphragm pump. The flow mechanism 70 causes ink to flow in such a way that the direction F of ink circulation inside the circulation path 68 is the same as the supply direction A from the liquid supply source 30 to the liquid ejecting unit 28 through the supply path 34. The control unit 40 controls the driving of the flow mechanism 70, too.

Figure 4:
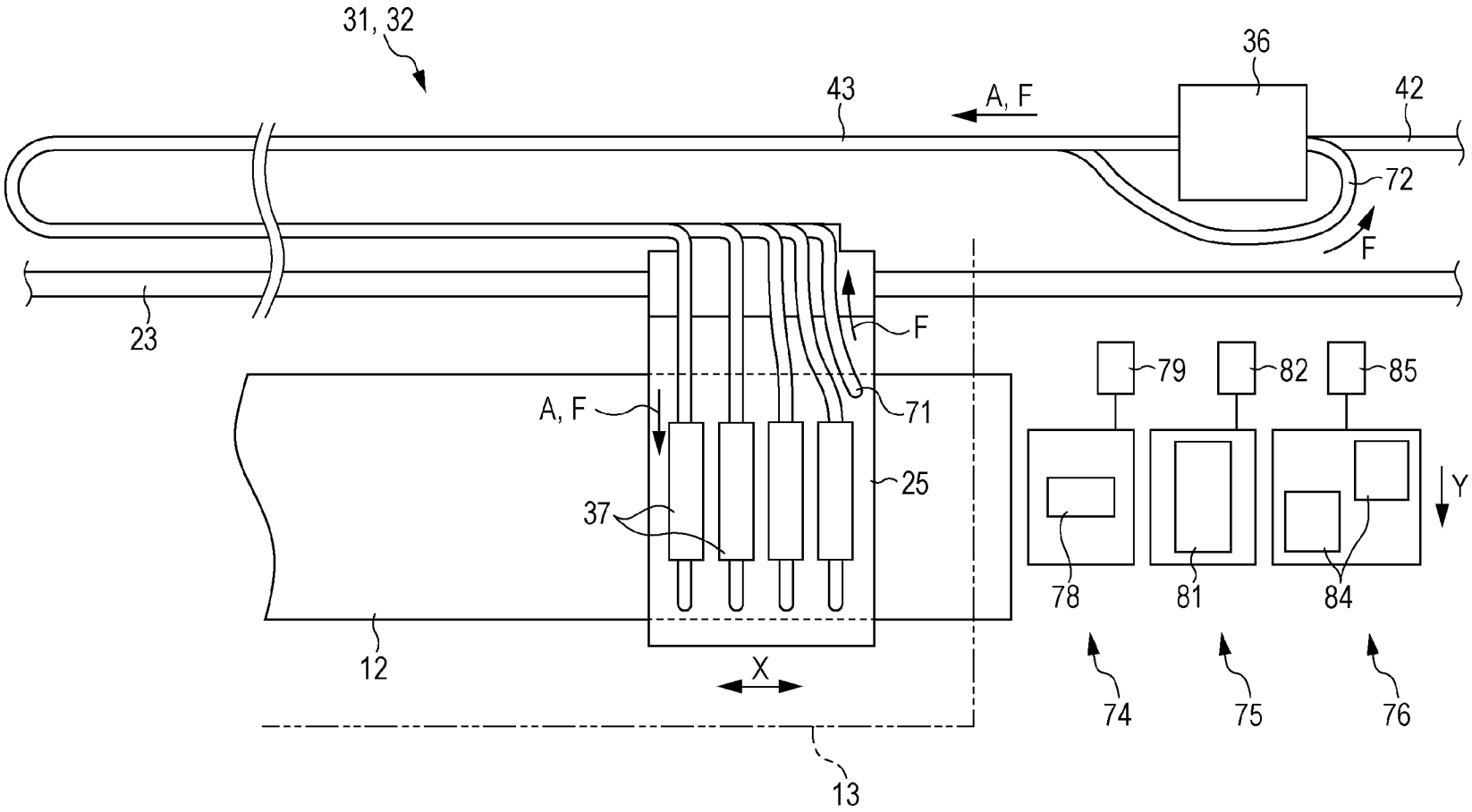
FIG. 4 is a schematic plan view of a carriage and a static mixer.

As illustrated in FIG. 4, at least one (four in the present embodiment) third supply passage 43 made of a tube(s) and at least one (one in the present embodiment) first branch passage 71 and second branch passage 72 are bundled into a flat shape, with a curve in a part of the flat bundle. The curved portion of the third supply passage 43 and the first branch passage 71 changes by following the movement of the carriage 25. The static mixers 37 of the supply mechanisms 31 and 32 are mounted and arranged on the carriage 25 in the scan direction X.

In the scan direction X, a wiper unit 74, a flushing unit 75, and a cap unit 76 are provided at a non-printing area, which is an area where the liquid ejecting units 28 do not face the sheet 13 that is being transported.

The wiper unit 74 includes a wiper 78 for wiping the nozzle surface 27. The wiper 78 of the present embodiment is a movable wiper driven by a wiping motor 79 for wiping operation.

The flushing unit 75 includes a liquid receiver 81 for receiving ink. The liquid receiver 81 is a movable belt, and moves when driven by a flushing motor 82. "Flushing" is operation of ejecting (discharging) ink droplets forcibly from all of the nozzles 26 irrespectively of printing for the purpose of preventing or troubleshooting the clogging of the nozzles 26.

The cap unit 76 includes two cap portions 84, which are configured to cover the orifices of the nozzles 26 formed in the nozzle surface 27 of the respective two liquid ejecting units 28, and a capping motor 85 for elevation of the cap portions 84.

Next, operation performed when ink is ejected from the nozzles 26 toward the sheet 13 by the printer 11, which has the structure described above, will now be explained, with a focus on the operation of the first supply mechanisms 31 and the second supply mechanism 32.

As illustrated in FIG. 3, before ejection of ink from the nozzles 26, the control unit 40 drives the flow mechanism 70. As a result, in the second supply mechanism 32, ink circulates in the circulation direction F along the circulation path 68.

Since the ink flows through the static mixer 37 in this process, the circulation produces effects that are similar to stirring. In addition, air bubbles contained in the ink become smaller due to division, and the buoyant force of them becomes smaller than that before size reduction. The reduction in the buoyant force makes it easier for them to flow as the ink flows, even in a downward supply passage in the vertical direction Z, and makes the stay of them inside the supply passage less likely to occur. With further reductions in bubble size due to divisions, the self-collapsing of the air bubbles due to the internal own pressure of them occurs, which renders them more soluble in the ink and makes them easier to be supplied toward the liquid ejecting unit 28. Moreover, when ink flows through the static mixer 37, a foreign object contained in the ink is also stirred. The stirring makes it easier for the foreign object to flow as the ink flows, and makes the stay inside the supply passage less likely to occur.

Having passed through the static mixer 37, the ink flows into the liquid reservoir 38, through the branch path 69, and next into the second supply passage 42. Since the outlet value 52 is provided at the upstream side of the second supply passage 42, the ink with the air bubbles and the foreign object in the second supply passage 42 flows into the upstream compartment 48 of the filter unit 36. At the filter unit 36, the air bubbles and the foreign object are trapped by the supply-source-side filter 53. Next, the ink flows into the static mixer 37 to be stirred, with changes in the flow again. Therefore, even if the ink inside the circulation path 68 is in an ingredient-precipitated state, the precipitation is reduced as a result of the flowing of the ink through the static mixer 37 along the circulation path 68.

After the circulation of the ink along the circulation path 68 by the flow mechanism 70 enough for reducing precipitation in the ink, the control unit 40 causes the flow mechanism 70 to stop. Next, the control unit 40 drives the carriage motor 24. That is, the carriage 25 performs moving operation of reciprocating in the scan direction X.

As illustrated in FIGS. 2 and 3, in each of the first supply mechanisms 31 and the second supply mechanism 32, the portion of the supply path 34 located between the liquid ejecting unit 28 and the static mixer 37 moves due to the movement of the carriage 25, and the ink in the moved path portion is stirred.

After the circulating operation and the moving operation, the control unit 40 drives the supply pump 35 to pressurize the ink in the supply path 34. Since the internal pressure of the supply path 34 (the supply path 34 and the branch path 69 in the second supply mechanism 32) is increased, even if any air bubbles remain in the ink, the air bubbles are rendered more soluble into the pressurized ink. In addition, the control unit 40 causes the liquid ejecting units 28 to perform maintenance operation of discharging ink from the nozzles 26. That is, the liquid ejecting units 28 are set into a flushing position over the liquid receiver 81, and eject ink into the liquid receiver 81 in this state. After the maintenance operation, the control unit 40 causes the liquid ejecting units 28 to perform print operation by ejecting ink onto the sheet 13.

Upon ink ejection by the liquid ejecting unit 28 in the maintenance operation and the print operation, ink contained in the liquid supply source 30 is supplied to the liquid ejecting unit 28 through the supply path 34. At this time, the ink located upstream of the static mixer 37 in the supply path 34 contains ink that is in an ingredient-precipitated state without following the movement of the carriage 25. Moreover, precipitation is more likely to occur in the ink located at the path area that has the level difference for connection between the low area D and the high area E. However, the ink mentioned here is supplied to the liquid ejecting unit 28 after flowing through the static mixer 37 to be stirred thereat.

Specifically, ink that has flowed through the static mixer 37 flows into the liquid reservoir 38 through the fourth supply passage 44. Since the liquid reservoir 38 includes the flexible member 58, which is urged by the spring 59, pressure fluctuations caused when the ink flows through the static mixer 37 are mitigated. A foreign object is removed when the ink flows through the ejecting-unit-side filter 54. The ink is supplied to the liquid ejecting unit 28 in a state in which its pressure has been regulated by the pressure regulation valve 39.

As described above, the carriage 25 causes the liquid ejecting units 28 to move before ejection of ink onto the sheet 13. In addition, before the ejection onto the sheet 13, the liquid ejecting units 28 perform maintenance operation of discharging ink from the nozzles 26.

The first embodiment described above produces the following advantageous effects.

(1) The ink in the portion of the supply path 34 located between the liquid ejecting unit 28 and the static mixer 37 moves due to the movement of the liquid ejecting unit 28. Therefore, the ink is stirred. On the other hand, the ink located closer to the liquid supply source 30 as compared with the static mixer 37 flows through the static mixer 37 when flowing toward the liquid ejecting unit 28 upon ink ejection by the liquid ejecting unit 28. Because of changes in the direction of the flow of the ink and the divisions of the flow of the ink, precipitation is reduced as if the ink were actually stirred. Therefore, when ink that contains precipitating ingredients is ejected, it is possible to reduce the precipitation of the ingredients with a simple structure.

(2) In ink that contains precipitating ingredients, the ingredients tend to gather at a relative low position. For this reason, at the path area having the level difference in the vertical direction Z for connection between the low area D and the high area E, there is a tendency that the density of the ingredients is high at a low position and is low at a high position. In this respect, in the structure of the present embodiment, on the supply path 34, the static mixer 37 is provided at a position closer to the liquid ejecting unit 28 than the path area having the level difference is. Therefore, it is possible to supply, to the liquid ejecting unit 28, liquid located at the path area having the level difference, at which the density difference of precipitating ingredients contained in the liquid is more likely to occur due to precipitation, after reducing the precipitation by causing the liquid to flow through the static mixer 37. On the supply path 34, the static mixer 37 is provided above the liquid ejecting unit 28 in the vertical direction Z at a position closer to the liquid ejecting unit 28 than the path area having the level difference is.

(3) Since the static mixer 37 gives rise to changes in the flow of ink through the supply path 34, for example, changes in the direction of the flow and the divisions of the flow, the pressure of the ink supplied to the liquid ejecting unit 28 through the supply path 34 also fluctuates. In this respect, in the structure of the present embodiment, the liquid reservoir 38, at least a part of which is made of the flexible member 58, is provided on the supply path 34 at a position closer to the liquid ejecting unit 28 than the static mixer 37 is. Therefore, it is possible to mitigate pressure fluctuations caused due to the flow of ink through the static mixer 37 by means of the liquid reservoir 38 provided therebetween.

(4) When ink flows through the static mixer 37, a foreign object contained in the ink is also stirred. The stirring makes it easier for the foreign object to flow as the ink flows, and makes it easier for the foreign object to be supplied toward the liquid ejecting unit 28. In addition, when air bubbles pass through the static mixer 37, they become smaller due to division, and the buoyant force of them becomes smaller than that before size reduction. The reduction in the buoyant force makes it easier for them to flow as the ink flows, even in a downward supply passage in the vertical direction Z, and makes them easier to be supplied toward the liquid ejecting unit 28. In this respect, ink that has flowed through the static mixer 37 flows through the ejecting-unit-side filter 54 before being supplied to the liquid ejecting unit 28. Therefore, even though flowing through the static mixer 37 makes it easier for a foreign object and air bubbles to flow as the ink flows, it is possible to trap the foreign object and the air bubbles by means of the ejecting-unit-side filter 54.

(5) A reduction in precipitation that is achieved by causing ink to flow through the static mixer 37 is greater than a reduction in precipitation that is achieved by moving the liquid ejecting unit 28. When ink is discharged from the nozzles 26 during maintenance operation, replenishing ink whose amount corresponds to the amount of the ink discharged is supplied from the liquid supply source 30 to the liquid ejecting unit 28 through the static mixer 37. Therefore, as compared with a case where ink is stirred by moving the liquid ejecting unit 28, it is possible to eject ink with a greater reduction in precipitation onto the sheet 13.

(6) Ink caused to flow by the flow mechanism 70 circulates along the circulation path 68. Since the ink flows through the static mixer 37 in this process, it is possible to further reduce precipitation.

(7) When the circulating operation is performed by the flow mechanism 70, the precipitation of ink inside the circulation path 68 is reduced. Since maintenance operation is performed after the circulating operation, ink with a reduction in precipitation by circulation along the circulation path 68 is supplied to the liquid ejecting unit 28. Therefore, by ejecting ink onto the sheet 13 after the maintenance operation, it is possible to eject the precipitation-reduced ink onto the sheet 13.

(8) The flow mechanism 70 causes ink to flow in such a way that the direction F of ink circulation along the circulation path 68 is the same as the supply direction A from the liquid supply source 30 to the liquid ejecting unit 28 through the supply path 34, and causes the ink to flow through the supply-source-side filter 53. Therefore, it is possible to prevent a foreign object or air bubbles trapped by the supply-source-side filter 53 in the course of circulation of ink by the flow mechanism 70 from coming off from the supply-source-side filter 53 and flowing together with the ink when the ink is supplied from the liquid supply source 30 to the liquid ejecting unit 28.

(9) Since the fifth supply passage 45 is connected to a top position of the filter compartment 61 in the vertical direction Z, it is possible to cause air bubbles trapped by the ejecting-unit-side filter 54 to move into the liquid reservoir 38 through the fifth supply passage 45 efficiently. Moreover, in the liquid reservoir 38, the connection position of the first branch passage 71 is located over the connection position of the fifth supply passage 45 in the vertical direction Z. Therefore, it is possible to cause the air bubbles inside the liquid reservoir 38 to flow into the circulation path 68 efficiently. The air bubbles flowing along the circulation path 68 are trapped by the supply-source-side filter 53. Since the supply-source-side filter 53 is replaceable, it is possible to enhance the air-bubble-discharging property of the second supply mechanism 32.

(10) When ink circulates along the circulation path 68, the ink flows through the static mixer 37. Therefore, as compared with a case where ink is circulated without the static mixer 37, it is possible to make time taken for reducing precipitation shorter.

Second Embodiment

Next, with reference to FIG. 5, a second embodiment will now be explained. The second embodiment is different from the first embodiment in that the filter compartment 61 of the second supply mechanism 32, which is provided with the circulation path 68, functions as an example of a liquid reservoir. Except for this point of difference, the structure of the second embodiment is substantially the same as the structure of the first embodiment. Therefore, the same reference numerals are assigned to the same components, and an explanation of them is not given here.

Figure 5:
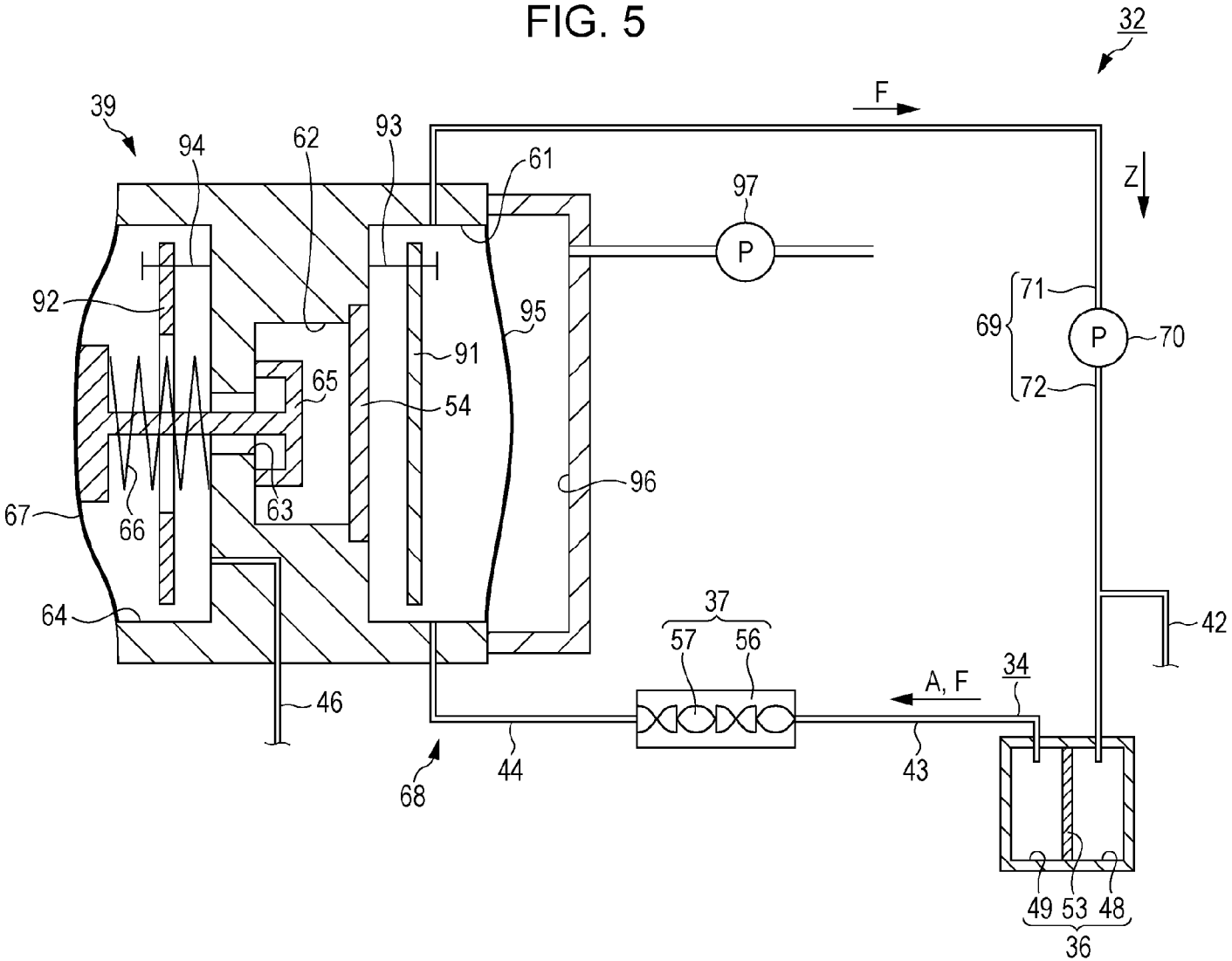
FIG. 5 is a schematic diagram of a pressure regulation valve according to a second embodiment.

As illustrated in FIG. 5, swing members 91 and 92 are provided inside the filter compartment 61 and the pressure compartment 64 respectively. The swing members 91 and 92 are configured to be able to swing due to the movement of the liquid ejecting units 28 by the carriage 25. Support shafts 93 and 94 extending in the movement direction of the valve element 65 are inserted through the swing members 91 and 92 respectively, and the swing members 91 and 92 can swing along the support shafts 93 and 94 respectively. The swing member 91, 92 is made of, for example, a metal plate. Since the specific gravity of the metal plate is greater than that of ink, it sinks in ink.

The supply path 34 and the branch path 69 are connected to the filter compartment 61. That is, the fourth supply passage 44 is connected to a bottom position of the filter compartment 61 in the vertical direction Z, and the first branch passage 71 is connected to a top position of the filter compartment 61 in the vertical direction Z.

A part of the wall surface of the filter compartment 61 is made of a diaphragm 95, which is an example of a deformable member similar to that of the pressure compartment 64. A pressurizing compartment with an enclosure 96 around the diaphragm 95 is provided opposite the filter compartment 61, with the diaphragm 95 interposed therebetween. In addition, an air pump 97 for increasing the internal pressure of the pressurizing compartment 96 is provided. The pressurizing compartment 96 and the air pump 97 applies an urging force to the ink inside the filter compartment 61 in a manner similar to the spring 59 in the first embodiment.

Next, the operation of the second supply mechanism 32 when the printer 11 having the structure described above ejects ink from the nozzles 26 toward the sheet 13 will now be explained. The control unit 40 drives the flow mechanism 70 and causes the flow mechanism 70 to perform circulating operation in the same way as in the first embodiment. The ink flows from the filter compartment 61 through the branch path 69, the filter unit 36, the third supply passage 43, the static mixer 37, and the fourth supply passage 44 in this order, and returns to the filter compartment 61. Precipitation is reduced because the ink flows through the static mixer 37 during circulation along the circulation path 68. A foreign object and air bubbles are trapped because the ink flows through the supply-source-side filter 53.

Next, the control unit 40 drives the carriage motor 24 to cause the carriage 25 to perform moving operation. Since the pressure regulation valve 39 moves due to the movement of the carriage 25, the swing members 91 and 92 swing inside the filter compartment 61 and the pressure compartment 64 respectively, and the ink is stirred inside the filter compartment 61 and the pressure compartment 64.

At this time, the air pump 97 is not driven, and the pressurizing compartment 96 is in an atmospheric-pressure state. Therefore, the capacity of the filter compartment 61 changes due to the movement of the carriage 25. Next, the control unit 40 drives the air pump 97 so as to increase the internal pressure of the pressurizing compartment 96. In addition, the control unit 40 causes the liquid ejecting units 28 to perform maintenance operation and print operation in the same way as in the first embodiment.

The second embodiment described above produces the following advantageous effect in addition to the advantageous effects (1) to (10) of the first embodiment.

(11) Since the swing member 91 is provided inside the filter compartment 61, the swing member 91 swings inside the filter compartment 61 when the carriage 25 causes the liquid ejecting units 28 to move. Therefore, it is possible to stir the ink inside the filter compartment 61 efficiently.

Third Embodiment

Next, with reference to FIG. 6, a third embodiment will now be explained. The third embodiment is different from the first embodiment in that the liquid ejecting unit is a so-called line head that performs printing by ejecting ink onto the entire area of the sheet 13 in the width direction. The same reference numerals are assigned to the same components as those of the first and second embodiments, and an explanation of them is not given here.

Figure 6:
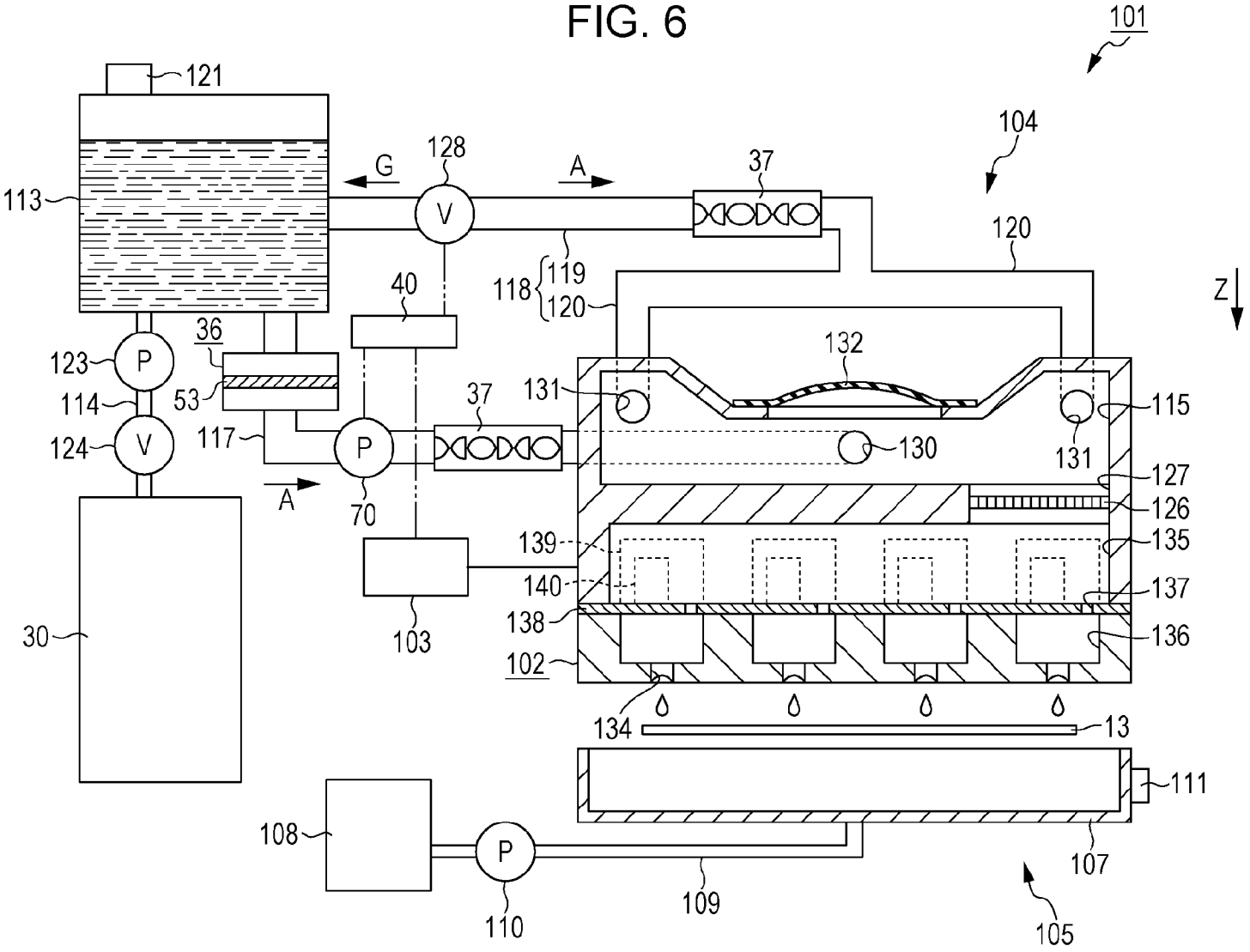
FIG. 6 is a schematic diagram of a printer according to a third embodiment.

As illustrated in FIG. 6, a printer 101, which is an example of a liquid ejecting apparatus, includes a liquid ejecting unit 102, which ejects ink, and an adjustment mechanism 103, which is an example of a movement mechanism that adjusts the position of the liquid ejecting unit 102. The printer 101 further includes a liquid supply mechanism 104, which supplies ink from the liquid supply source 30 to the liquid ejecting unit 102, and a maintenance mechanism 105, which performs maintenance on the liquid ejecting unit 102. The liquid ejecting unit 102 can move up and down in relation to the sheet 13. The position of the liquid ejecting unit 102 is adjusted by the adjustment mechanism 103, which is driven and controlled by the control unit 40. At least one liquid supply mechanism 104 is provided, wherein it is provided for each type of ink. The liquid ejecting unit 102 may be provided for each type of ink or functional liquid. In such a case, plural liquid ejecting units 102 are arranged at intervals in the transportation direction of the sheet 13. If the functional liquid includes pre-treatment liquid, preferably, a liquid ejecting unit 102 that ejects the pre-treatment liquid should be provided at the most upstream position in the transportation direction. If the functional liquid includes post-treatment liquid, preferably, a liquid ejecting unit 102 that ejects the post-treatment liquid should be provided at the most downstream position in the transportation direction.

The maintenance mechanism 105 includes a cap 107, which can move in relation to the liquid ejecting unit 102, a waste liquid container 108, and a liquid drain passage 109 for connection between the cap 107 and the waste liquid container 108. The maintenance mechanism 105 further includes a pressure reducing mechanism 110, which is provided on the liquid drain passage 109, and an air open valve 111, which is provided on the cap 107.

The liquid supply mechanism 104 includes a liquid container 113, which contains ink, a filling passage 114 for connection between the liquid supply source 30 and the liquid container 113, a supply passage 117 for connection between the liquid container 113 and a liquid reservoir 115, and a return passage 118 for another-path connection between the liquid container 113 and the liquid reservoir 115. The return passage 118, which is an example of a branch path, includes a main passage 119, which is in communication with the liquid container 113, and plural (for example, two) branches 120 from the main passage 119; the branches 120 are in communication with the liquid reservoir 115 at plural (for example, two) places respectively. An air communication valve 121 is provided on the liquid container 113. When the air communication valve 121 is open, the liquid container 113 is open to the outside air.

A filling pump 123, which causes ink to flow from the liquid supply source 30 to the liquid container 113, and a filling valve 124, which opens and closes the filling passage 114 between the liquid supply source 30 and the filling pump 123, are provided on the filling passage 114. When the filling pump 123 is driven in a state in which the filling valve 124 is open, ink is filled into the liquid container 113 from the liquid supply source 30.

The liquid reservoir 115 and the liquid ejecting unit 102 of the present embodiment are integrated as a single unit. There is a filter chamber 127, inside which an ejecting-unit-side filter 126 is provided, between the liquid reservoir 115 and the liquid ejecting unit 102. The filling passage 114 and the supply passage 117 of the present embodiment function as an example of a supply path through which ink is supplied from the liquid supply source 30 to the liquid ejecting unit 102. The supply passage 117 and the return passage 118 make up a circulation path.

The filter unit 36, which is provided with the supply-source-side filter 53, the flow mechanism 70, which causes ink to flow, and the static mixer 37 are provided on the supply passage 117. A restriction unit 128, which can restrict the flow of ink, and another static mixer 37 (which is not the static mixer 37 provided on the supply passage 117) are provided on the main passage 119. The control unit 40 controls the driving of the flow mechanism 70 and the restriction unit 128.

The restriction unit 128 is a valve that switches between an open state and a closed state. When this valve is closed, the flow of ink through the main passage 119 is restricted. When this valve is open, ink is allowed to flow therethrough. In the supply passage 117 and the return passage 118, the flow direction from the liquid container 113 to the liquid reservoir 115 is referred to as the supply direction A. In the return passage 118, the flow direction from the liquid reservoir 115 to the liquid container 113 is referred to as a return direction G.

The flow mechanism 70 of the present embodiment is a pump that causes ink to flow from the liquid container 113 to the liquid reservoir 115, whereas, when in a stopped state, the flow of ink is not restricted. The flow mechanism 70 is, for example, a gear pump or a diaphragm pump. If the flow mechanism 70 is a diaphragm pump, preferably, it should include a pump chamber whose capacity changes as driven, an inlet value provided at a position closer to the liquid container 113 than the pump chamber is, and an outlet value provided at a position closer to the liquid reservoir 115 than the pump chamber is.

The liquid reservoir 115, which retains ink, has an inlet 130 and plural (for example, two) outlets 131. The supply passage 117 is connected to the inlet 130. The branches 120 of the return passage 118 are connected to the outlets 131 respectively. At least a part of the liquid reservoir 115 is made of a flexible member 132, which can deform and thereby change the capacity of the liquid reservoir 115. Preferably, the plural outlets 131 formed in the liquid reservoir 115 should be located at positions closer to the ends in the length direction (horizontal direction in FIG. 6) of the liquid reservoir 115 than the inlet 130 is. Preferably, the inlet 130 should be located between the two outlets 131 arranged in the length direction.

Moreover, preferably, in the liquid reservoir 115, the outlets 131 should be located above the inlet 130 in the vertical direction Z, and the ceiling of the liquid reservoir 115 should be inclined upward from the center toward the ends in the length direction. This is because, with this structure, it is easier for air bubbles having entered the liquid reservoir 115 to move along the inclined ceiling toward the ends, near which the outlets 131 are located, and to flow into the return passage 118 through the outlets 131. In FIG. 6, the flexible member 132 is illustrated at the ceiling. However, preferably, the flexible member 132 should be provided at a surface other than the ceiling (for example, a side or the bottom) because, with such a structure, air bubbles are less likely to stay.

Preferably, the connection portion of the liquid reservoir 115 to the filter chamber 127 should be located at a position closer to the outlet 131 than the inlet 130, and should be located below the inlet 130 and the outlets 131 in the vertical direction Z. This is because, with this structure, it is possible to prevent air bubbles or a foreign object having entered the liquid reservoir 115 through the inlet 130 from flowing into the filter chamber 127.

The liquid ejecting unit 102 includes plural nozzles 134, from which liquid droplets are ejected, a common liquid chamber 135 for the ink supplied from the liquid reservoir 115 through the filter chamber 127, and plural liquid compartments (chambers) 136, which are in communication with the common liquid chamber 135 and the nozzles 134.

That is, the common liquid chamber 135 is in communication with the liquid reservoir 115 through the filter chamber 127, and is in communication with the liquid compartments 136 through respective holes 137. A part of the wall surface of the liquid compartments 136 is made of a vibration plate 138. One surface of the vibration plate 138 faces the liquid compartments 136. Actuators 140, which are housed inside respective housing compartments 139, are provided on the opposite surface of the vibration plate 138 at respective positions different from the common liquid chamber 135.

The actuator 140 is, for example, a piezoelectric element that contracts when a driving voltage is applied to it. The vibration plate 138 deforms as a result of the applying of driving voltages to the actuators 140 and the stopping of the applying of the driving voltages. The deformation causes changes in the capacity of the liquid compartments 136. Therefore, the ink in the liquid compartments 136 is ejected from the nozzles 134 in the form of droplets.

Next, operation performed when ink is ejected from the nozzles 134 toward the sheet 13 by the printer 101, which has the structure described above, will now be explained, with a focus on the operation of the liquid supply mechanism 104.

As illustrated in FIG. 6, before ejection of ink from the nozzles 134, the control unit 40 drives the adjustment mechanism 103. As a result, the liquid ejecting unit 102 moves together with the filter chamber 127, the liquid reservoir 115, a part of the supply passage 117, and a part of the return passage 118. The ink in the moved portion is stirred.

Next, the control unit 40 drives the flow mechanism 70 in a state in which the flow through the return passage 118 is not restricted by the restriction unit 128. As a result, the ink contained in the liquid container 113 flows through the supply passage 117, the liquid reservoir 115, and the return passage 118 in this order. That is, during this process, the ink flows through the supply passage 117 in the supply direction A, and flows into the liquid reservoir 115 through the inlet 130. Next, the ink flows into the branches 120 of the return passage 118 from the liquid reservoir 115 through the respective outlets 131, flows in the return direction G through the main passage 119 after the merge, and returns to the liquid container 113. The ink circulates in this way.

When the ink circulates, it flows through the static mixer 37 and the filter unit 36. Since the ink in the portion that does not move by following the liquid ejecting unit 102 also flows through the static mixer 37, precipitation is reduced. Moreover, a foreign object and air bubbles in the ink are trapped by the filter unit 36.

After the circulation of the ink by the flow mechanism 70 enough for reducing precipitation in the ink, the control unit 40 causes the restriction unit 128 to restrict the flow through the return passage 118. As a result, the ink contained in the liquid container 113 flows through the supply passage 117, the liquid reservoir 115, the filter chamber 127, the common liquid chamber 135, and the liquid compartments 136 in this order, and is finally ejected from the nozzles 134. That is, the control unit 40 causes the liquid ejecting unit 102 to perform maintenance operation of discharging the ink from the nozzles 134. Instead of discharging the ink from the nozzles 134 by the driving of the flow mechanism 70 described above, as maintenance operation, flushing may be performed by the driving of the actuators 140. Alternatively, as maintenance operation, flushing may be performed by the driving of the actuators 140 while discharging ink from the nozzles 134 by the driving of the flow mechanism 70, or, the actuators 140 may be driven without discharging ink from the nozzles 13.

After the maintenance operation, the control unit 40 stops the driving of the flow mechanism 70 and removes the restriction by the restriction unit 128. As a result, through both of the supply passage 117 and the return passage 118, the ink contained in the liquid container 113 flows in the supply direction A while being stirred by going through the respective static mixers 37. The liquid reservoir 115 is replenished with this ink. In this state, the liquid ejecting unit 102 performs print operation by ejecting ink onto the sheet 13.

The third embodiment described above produces the following advantageous effect in addition to the advantageous effects (1) to (11) of the first and second embodiments.

(12) The liquid ejecting unit 102 performs print operation after being moved by the adjustment mechanism 103, which adjusts the position of the liquid ejecting unit 102. That is, even in the printer 101, which uses the large-sized liquid ejecting unit 102, which is capable of ejecting ink onto the entire area of the sheet 13 in the width direction, it is possible to perform print operation by ejecting precipitation-reduced ink.

Fourth Embodiment

Next, with reference to FIGS. 7 and 8, a fourth embodiment will now be explained. The difference between the fourth embodiment and the first embodiment lies in the structure of the first supply mechanism and the liquid supply source. The same reference numerals are assigned to the same components as those of the first, second, and third embodiments, and an explanation of them is not given here.

Figure 7:
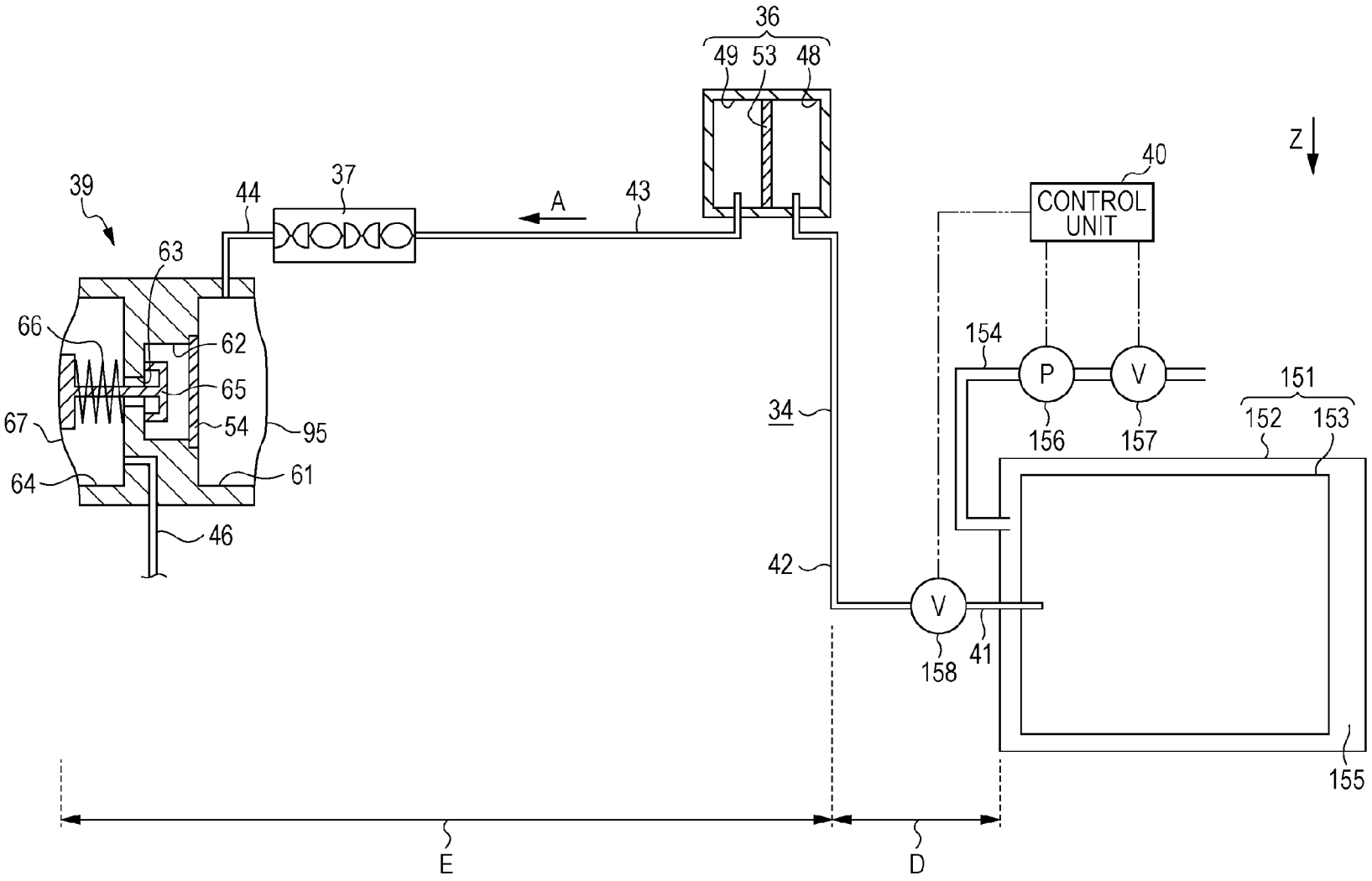
FIG. 7 is a schematic diagram of a first supply mechanism according to a fourth embodiment.

As illustrated in FIG. 7, a liquid supply source 151 includes an outer case 152, which is an airtight enclosure, and an ink pack 153, which is housed inside the outer case 152. The ink pack 153 containing ink is deformable and sealed. In a state in which the liquid supply source 151 is mounted on the printer 11, the other end of a pressuring passage 154, one end of which is open to the outside air, is in communication with an air space 155 between the outer case 152 and the ink pack 153.

A pressurizing pump 156 and a release valve 157 are provided on a pressurizing passage 154. The air space 155 is pressurized as a result of the driving of the pressurizing pump 156 when the release valve 157 is open. Then, the release valve 157 is closed in a state in which the air space 155 is pressurized by the pressurizing pump 156. As a result, the inside of the air space 155 is kept in a pressurized state.

A supply valve 158 is provided on the supply path 34 between the filter unit 36 and the liquid supply source 151. The control unit 40 controls the driving of the pressurizing pump 156, the release valve 157, and the supply valve 158.

The supply valve 158 and the liquid supply source 151 are provided below the filter unit 36 in the vertical direction Z. That is, the first supply passage 41, the supply valve 158, and a part of the second supply passage 42 are provided at the low area D. A part of the second supply passage 42, the filter unit 36, the third supply passage 43, the static mixer 37, the fourth supply passage 44, and the pressure regulation valve 39 are provided at the high area E. The first supply passage 41 is provided below the filter compartment 61 of the pressure regulation valve 39 in the vertical direction Z.

Next, operation performed when ink is ejected from the nozzles 26 toward the sheet 13 by the printer 11 having the structure described above will now be explained. As illustrated in FIG. 7, the control unit 40 drives the pressurizing pump 156 to pressurize the air space 155, thereby supplying ink from the liquid supply source 151. The diaphragm 95 of the filter compartment 61, into which ink is supplied as a result of pressurization, deforms in such a way as to increase the capacity of the filter compartment 61. The supply valve 158 is open at this time.

The filter compartment 61 is located above the liquid supply source 151 in the vertical direction Z. For this reason, when the driving of the pressurizing pump 156 is stopped in a state in which the release valve 157 and the supply valve 158 are open, ink flows in a direction that is the opposite of the supply direction A between the liquid supply source 151 and the filter compartment 61. Since the ink flows through the static mixer 37 in this process, it is stirred.

Figure 8:
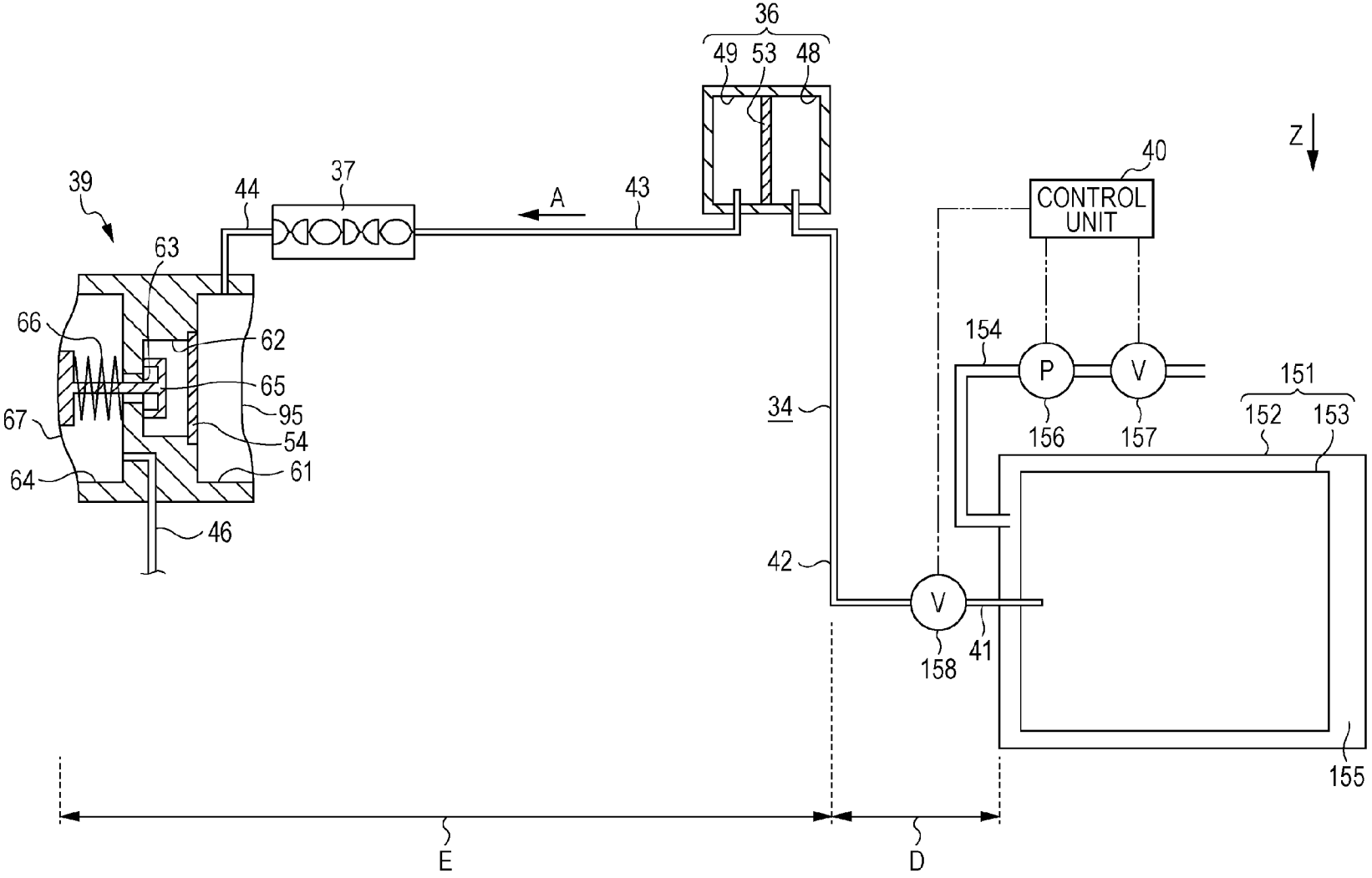
FIG. 8 is a schematic diagram of a first supply mechanism when pressure is not applied.

That is, as illustrated in FIG. 8, the capacity of the filter compartment 61 decreases due to the deformation of the diaphragm 95 of the filter compartment 61 toward the ejecting-unit-side filter 54. When the pressurizing pump 156 is driven by the control unit 40 again, ink flows in the supply direction A. Since the ink flows through the static mixer 37 in this process, it is stirred.

After the repetition of the driving and stopping of the pressurizing pump 156 plural times, the control unit 40 opens the release valve 157 and the supply valve 158, with the pressurizing pump 156 stopped. In addition, the control unit 40 drives the carriage motor 24 (refer to FIG. 2) to cause the carriage 25 (refer to FIG. 2) to perform moving operation of reciprocating in the scan direction X. The portion of the supply path 34 located between the liquid ejecting unit 28 and the static mixer 37 moves due to the movement of the carriage 25.

Since the flow of ink is allowed between the filter compartment 61 and the liquid supply source 151 at this time, the capacity of the filter compartment 61 and the capacity of the ink pack 153 change due to the movement of the carriage 25, and ink flows through the supply path 34.

Next, the control unit 40 causes the liquid ejecting unit 28 to perform maintenance operation of discharging ink from the nozzles 26. After the maintenance operation, the control unit 40 causes the liquid ejecting unit 28 to perform print operation by ejecting ink onto the sheet 13.

The fourth embodiment described above produces the following advantageous effects in addition to the advantageous effects (1) to (12) of the first, second, and third embodiments.

(13) Since a part of the filter compartment 61 is made of the diaphragm 95, which is flexible, when the carriage 25 causes the liquid ejecting unit 28 to move, the capacity of the filter compartment 61 changes. Therefore, it is possible to increase the efficiency of stirring ink inside the filter compartment 61 and ink in the supply path 34 between the filter compartment 61 and the liquid supply source 151.

(14) Since the liquid supply source 151 is located below the filter compartment 61 in the vertical direction Z, it is possible to move the ink inside the filter compartment 61 toward the liquid supply source 151 by utilizing a hydraulic head difference. Therefore, it is possible to cause ink to flow with a simple structure.

The foregoing embodiments may be modified as follows.

In each of the foregoing embodiments, the supply-source-side filter 53 may be omitted.

In each of the foregoing embodiments, the filter unit 36 may be non-replaceable.

In each of the foregoing embodiments, the capability of the supply-source-side filter 53 of the filter unit 36 for trapping a foreign object or air bubbles may be greater than the trapping capability of the ejecting-unit-side filter 54, 126. The area size of the supply-source-side filter 53 may be larger than the area size of the ejecting-unit-side filter 54, 126.

In each of the foregoing embodiments, the filter unit 36 and the supply-source-side filter 53 may be provided at any position on the circulation path 68. That is, on the circulation path 68, the filter unit 36 may be provided between the static mixer 37 and the liquid reservoir 38, or on the branch path 69. Plural filter units 36 may be provided on the circulation path 68.

In the first and second embodiments, the circulation direction F may be the opposite of the supply direction A on the supply path 34.

In the third embodiment, the restriction unit 128 may restrict the flow through the return passage 118 when ink is supplied from the liquid container 113 to the liquid reservoir 115. That is, the ink may be supplied from the liquid container 113 to the liquid reservoir 115 through the supply passage 117 only. Then, the flow mechanism 70 may be driven with the removal of the restriction by the restriction unit 128 to cause the ink to circulate. The flow mechanism 70 may cause the ink to flow in a direction that is the opposite of the supply direction A through the supply passage 117.

It is described in the first and second embodiments that the control unit 40 causes the flow mechanism 70 to perform circulating operation for circulation of ink along the circulation path 68 enough for reducing precipitation in the ink before ejection of the ink from the nozzles 26. However, the circulating operation may be omitted. For example, the control unit 40 may stop the driving of the flow mechanism 70 after the ink inside the fourth supply passage 44 has flowed into the first branch passage 71. Alternatively, the control unit 40 may stop the driving of the flow mechanism 70 after the flow of ink corresponding to the sum of the capacity of the fourth supply passage 44 and the capacity of the liquid reservoir 38 (in the second embodiment, the capacity of the filter compartment 61).

In each of the foregoing embodiments, regarding the operation performed before ejection of ink onto the sheet 13 by the liquid ejecting unit 28, circulating operation and maintenance operation may be omitted. Alternatively, either circulating operation or maintenance operation, not both, may be performed. The sequential order of maintenance operation, circulating operation, and moving operation can be changed arbitrarily.

In each of the foregoing embodiments, regarding the operation performed before ejection of ink onto the sheet 13 by the liquid ejecting unit 28, 102, any two of circulating operation, maintenance operation, and moving operation may be performed at the same time. For example, in the third embodiment, before ejection of ink from the nozzles 134, the control unit 40 may drive and cause the flow mechanism 70 to perform circulating operation while driving and causing the adjustment mechanism 103 to perform moving operation. The control unit 40 may cause the liquid ejecting unit 102 to perform maintenance operation of discharging ink from the nozzles 134 while driving and causing the flow mechanism 70 to perform circulating operation.

In the third embodiment, if time taken for the operation performed before ejection of ink onto the sheet 13 by the liquid ejecting units 102 (hereinafter referred to as "before-ejection operation") differs from one type of ink or functional liquid to another, the transportation of the sheet 13 may be started before the completion of the before-ejection operation for all of the liquid ejecting units 102. For example, if a liquid ejecting unit 102 that ejects pre-treatment liquid or ink that is less likely to precipitate is included therein, time taken for circulating operation for such liquid or ink is shorter than that of ink that is more likely to precipitate, or it could be unnecessary. For this reason, the before-ejection operation for a liquid ejecting unit 102 that ejects pre-treatment liquid or ink that is less likely to precipitate ends earlier than the before-ejection operation for a liquid ejecting unit 102 that ejects ink that is more likely to precipitate. In such a case, if the transportation of the sheet 13 is started at a point in time of the completion of the before-ejection operation for the liquid ejecting unit 102 that ejects pre-treatment liquid or ink that is less likely to precipitate, it is possible to shorten the time taken before ejection of ink onto the sheet 13 by the liquid ejecting unit 102. The liquid ejecting unit 102 that ejects pre-treatment liquid or ink that is less likely to precipitate may be arranged at the upstream side in the transportation direction of the sheet 13. By this means, the ejection onto the sheet 13 by the liquid ejecting unit 102 that ejects pre-treatment liquid or ink that is less likely to precipitate may be performed before the completion of the before-ejection operation for the liquid ejecting unit 102 that ejects ink that is more likely to precipitate.

In each of the foregoing embodiments, maintenance operation may be performed by applying negative pressure from the nozzle-surface side 27 of the liquid ejecting unit 28 to suck ink out of the nozzles 26. For example, in the third embodiment, the pressure reducing mechanism 110 may be driven in a state in which the cap 107 is in contact with the liquid ejecting unit 102 to suck ink out of the nozzles 134.

In the first and second embodiments, the branch path 69 and the flow mechanism 70 may be omitted. That is, the first supply mechanism 31 only, without the second supply mechanism 32, may be provided. Alternatively, the second supply mechanism 32 only, without the first supply mechanism 31, may be provided. In the third embodiment, the return passage 118 may be omitted. In the fourth embodiment, the branch path 69 may be provided.

In each of the foregoing embodiments, the ejecting-unit-side filter 54, 126 may be omitted. The ejecting-unit-side filter 54 may be provided separately from the pressure regulation valve 39. For example, the ejecting-unit-side filter 54 may be provided in at least one of the fourth, fifth, and sixth supply passages 44, 45, and 46.

In the second embodiment, the swing members 91 and 92 may be omitted. Either the swing member 91 or 92, not both, may be provided. In the first and third embodiments, a swing member may be provided inside the liquid reservoir 38, 115. In the fourth embodiment, a swing member may be provided inside the filter compartment 61 or the pressure compartment 64, or both. The shape of the swing member 91, 92 may be modified into, besides a plate shape, for example, a spherical shape, a rod shape, or a net shape.

In each of the foregoing embodiments, the liquid reservoir 38, 115 and/or the filter compartment 61 may be not provided with the flexible member 58, 132 and/or the diaphragm 95. That is, the capacity of the liquid reservoir 38, 115 and/or the capacity of the filter compartment 61 may be invariable. Alternatively, the entirety of the liquid reservoir 38, 115 and/or the filter compartment 61 may be made of a flexible member.

In the first, second, and fourth embodiments, the entirety of the supply path 34 and the branch path 69 may be located at the high area E. The static mixer 37 may be located at the low area D.

In the first and second embodiments, in addition to the static mixer 37 provided on the supply path 34, an additional static mixer may be provided in the first branch passage 71 or the second branch passage 72, or both.

In each of the foregoing embodiments, the static mixer 37 may be provided in a downward supply passage (for example, the fourth supply passage 44, the fifth supply passage 45, or the sixth supply passage 46 in the first embodiment) in the vertical direction Z so as to make air bubbles smaller by the static mixer 37 and make it easier for them to flow as ink flows. By this means, it is possible to make it easier to discharge air bubbles together with ink discharged from the nozzles 26, 134 by performing maintenance operation.

In the first embodiment, the filter compartment 61 may be provided with the diaphragm 95. In addition, the air pump 97 and the pressurizing compartment 96 for urging the diaphragm 95 may be provided.

In the third embodiment, the liquid ejecting unit 102 may be moved by being pushed up by the cap 107, which can move up and down. In such a case, the cap 107 functions as an example of a movement mechanism that causes the liquid ejecting unit 102 to move.

In each of the foregoing embodiments, it is not always necessary that each split plate 57 as an element in the static mixer 37 should have a shape of a substantially rectangular plate material twisted by 180° and that each two adjacent split plates 57 should be fixed with an angular shift of 90° from each other. The number of the split plates 57, the twist state of each of the split plates 57, the size and material of each of the split plates 57, and the like should be designed so as to minimize flow passage loss depending on the properties of liquid.

In each of the foregoing embodiments, the shape of each element of the static mixer 37 is not limited to a plate as long as it is possible to apply rotational twist or flow division to liquid flowing through the element. For example, the elements may be constituted by alternately providing spiral members whose winding directions are different from each other in a direction in which the ink inside the supply passage flows.

In each of the foregoing embodiments, the liquid ejecting apparatus may eject and/or discharge any liquid other than ink. Examples of the state of a droplet outputted as an ultra-small amount of the liquid from the liquid ejecting apparatus are: a particulate droplet, a tear-shaped droplet, and a viscous droplet that forms a thread tail. The "liquid" mentioned herein may be any liquid that contains precipitating ingredients and is made of a material that can be ejected by a liquid ejecting apparatus. Any material whose substance is in the liquid phase can be used, for example: liquid that has high viscosity or low viscosity, sol or gel water, or other fluid such as inorganic solvent, organic solvent, solution, liquid resin, or liquid metal (metal melt), though not limited thereto. The "liquid" is not limited to liquid as a state of substance. It encompasses a liquid matter that is made as a result of dissolution, dispersion, or mixture of particles of a functional material made of a solid such as pigment, metal particles, or the like into/with a solvent, though not limited thereto. Ink described in the foregoing embodiments, liquid crystal, etc. are typical examples of the liquid. "Ink" encompasses various kinds having various liquid compositions such as popular water-based ink, oil-based ink, gel ink, and hot melt ink, etc. A specific example of the liquid ejecting apparatus is: an apparatus that ejects liquid in which, for example, a material such as an electrode material, a color material, or the like that is used in the production of a liquid crystal display, an EL (electroluminescence) display, a surface emission display, a color filter, or the like is dispersed or dissolved.

The entire disclosure of Japanese Patent Application No. 2014-244725, filed Dec. 3, 2014 is expressly incorporated by reference herein.

What is claimed is:

1. A liquid ejecting apparatus, comprising:

a liquid ejecting section that ejects liquid;

a supply path through which the liquid is supplied from a liquid supply source to the liquid ejecting section;

a movement mechanism that causes the liquid ejecting section to move; and a static mixer that is provided on the supply path and gives rise to a change in a flow of the liquid through the supply path;

wherein the movement mechanism causes the liquid ejecting section to move before ejection of the liquid onto a medium by the liquid ejecting section, and the supply path located between the liquid ejecting section and the static mixer moves due to the movement.

2. The liquid ejecting apparatus according to claim 1, wherein the supply path includes a path portion that has a level difference; and wherein, on the supply path, the static mixer is provided at a position closer to the liquid ejecting section than the path portion having the level difference is.

3. The liquid ejecting apparatus according to claim 1, further comprising:

a liquid reservoir that retains the liquid and is provided on the supply path at a position closer to the liquid ejecting section than the static mixer is, wherein at least a part of the liquid reservoir is made of a flexible member.

4. The liquid ejecting apparatus according to claim 3, wherein a swing member configured to be able to swing due to the movement of the liquid ejecting section by the movement mechanism is provided inside the liquid reservoir.

5. The liquid ejecting apparatus according to claim 3, further comprising:

an ejecting-section-side filter that is provided on the supply path at a position closer to the liquid ejecting section than the liquid reservoir is.

6. The liquid ejecting apparatus according to claim 1, wherein the liquid ejecting section performs maintenance operation of discharging the liquid from a nozzle before the ejection of the liquid onto the medium.

7. The liquid ejecting apparatus according to claim 1, further comprising:

a branch path, one end of which is connected on the supply path to a position closer to the liquid supply source than the static mixer is, the other end of which is connected on the supply path to a position closer to the liquid ejecting section than the static mixer is, the branch path and the supply path working together so as to constitute a circulation path for circulation of the liquid; and a flow mechanism that causes the liquid inside the circulation path to flow.

8. The liquid ejecting apparatus according to claim 7, wherein the flow mechanism performs circulating operation of causing the liquid to circulate along the circulation path;

wherein, after the circulating operation, the liquid ejecting section performs maintenance operation of discharging the liquid from a nozzle; and wherein, after the maintenance operation, the liquid ejecting section ejects the liquid onto the medium.

9. The liquid ejecting apparatus according to claim 7, further comprising:

a supply-source-side filter that is provided, in the circulation path, either on the supply path at a position closer to the liquid supply source than the static mixer is or on the branch path, or on both, wherein the flow mechanism causes the liquid to flow through the supply path from the liquid supply source toward the liquid ejecting section.

* * * * *